US005221836A

United States Patent [19]

Kinoshita

[11] Patent Number: 5,221,836

[45] Date of Patent: Jun. 22, 1993

[54] STREAK TUBE HAVING AN ARRANGEMENT FOR SUPPRESSING TRAVEL TIME SPREAD OF PHOTOELECTRONS

[75] Inventor: Katsuyuki Kinoshita, Hamamatsu, Japan

[73] Assignee: Hamamatsu Photonics K.K., Shizuoka, Japan

[21] Appl. No.: 755,976

[22] Filed: Sep. 6, 1991

[30] Foreign Application Priority Data

Sep. 7, 1990 [JP] Japan ..... 2-238457

[51] Int. Cl.[5] ..... H01J 31/50

[52] U.S. Cl. ..... 250/214 VT; 313/529

[58] Field of Search ..... 250/213 VT, 370.09, 250/363.1; 313/529, 390, 537, 383, 447, 376, 381, 382, 541, 544

[56] References Cited

U.S. PATENT DOCUMENTS

| | | | |
|---|---|---|---|
| 3,863,087 | 1/1975 | Holz | 313/585 |
| 4,891,581 | 1/1990 | Takiguchi | 250/213 VT |
| 4,902,927 | 2/1990 | Kinoshita . | |
| 4,926,039 | 5/1990 | Garfield et al. | 250/213 VT |
| 4,947,031 | 8/1990 | Koishi et al. | 313/529 |

FOREIGN PATENT DOCUMENTS 0315435 5/1989 European Pat. Off. .

OTHER PUBLICATIONS

Review Of Scientific Instruments vol. 58, "Femtosecond streak tube" K. Kinoshita, et al. pp. 932–938; Jun. 1987.

*Primary Examiner*—David C. Nelms
*Assistant Examiner*—Que T. Le
*Attorney, Agent, or Firm*—Sughrue, Mion, Zinn, Macpeak & Seas

[57] ABSTRACT

In a streak tube wherein a photocathode and an acceleration electrode are disposed in confronting relation to each other for accelerating a photoelectron beam emitted from the photocathode, at least one of the photocathode and the acceleration electrode is formed on a strip-like electrode. A pulse voltage is applied to the strip-like electrode, whereby a very intensive pulsed electric field is developed between the photocathode and the acceleration electrode with the application of a relatively low pulse voltage. Interactive regions of the photocathode and the acceleration electrode are closely position with high accuracy. The streak tube can thus generate a streaked image with a very high time resolution without an increase in the background emission on a phosphor screen.

30 Claims, 7 Drawing Sheets

PULSE VOLTAGE GENERATOR
36
34
34A
34B
30A
30B
60A
60
58A
58
26
22
26A
62
64
38
42
46
44
32
52
48
54
56
40
50
20
50Ω
400pS
+1.5KV
0V
-1.5KV
t

PULSE VOLTAGE GENERATOR
36
34
30A
30B
58
62
22
26
38
78
84
82
86
52
32
40
50
200pS
+1.5KV
0
-1.5KV
t
1nS
-7KV
-10KV

STREAK TUBE HAVING AN ARRANGEMENT FOR SUPPRESSING TRAVEL TIME SPREAD OF PHOTOELECTRONS

BACKGROUND OF THE INVENTION

1. Field of the Invention

The present invention relates to a streak tube capable of measuring a high-speed time-dependent change in the brightness of light within several hundred femtoseconds. More particularly, the invention relates to a streak tube having an arrangement for suppressing travel time spread of photoelectrons caused by difference in energy in each photoelectron emitted from a photocathode.

2. Description of Prior Art

Streak tubes are devices for converting a time-dependent intensity distribution of light to be measured into a spatial intensity distribution on an output plane. Since the streak tubes have a picosecond time resolution, they are used for an analysis of the phenomenon of light at ultrahigh speed.

A conventional streak tube has a structure as shown in FIGS. 1A, 1B, 2A and 2B of the accompanying drawings.

FIG. 1A is a cross-sectional view showing the streak tube, taken along a plane parallel to deflection electrodes, and FIG. 1B is a diagram showing the relationship between a photocathode and an optical image formed thereon in the streak tube shown in FIG. 1A. FIG. 2A is a cross-sectional view showing the streak tube, taken along a plane including the axis of the streak tube and perpendicular to the deflection electrodes, and FIG. 2B is a diagram view showing the relationship between a photocathode and an optical image formed thereon in FIG. 2A. As shown in FIGS. 1A, 1B, 2A, and 2B, the streak tube, generally denoted by reference numeral 1, includes a hermetic vacuum casing 2 which has an input window 3 on one end of the casing 2, for focusing thereon an optical image to be analyzed, and an output window 4 on the other end of the casing 2, for emitting the processed optical image out of the casing 2.

Between the input and output windows 3, 4, there are successively disposed, along the axis of the streak tube 1, a photocathode 5, an acceleration mesh electrode 6, a focusing electrode 7, an aperture electrode 8, deflection electrodes 9, and a phosphor screen 10. Progressively higher voltages are applied to the focusing electrode 7, the mesh electrode 6, and the aperture electrode 8 in the stated order with respect to the photocathode 5. The same potential as that of the aperture electrode 8 is applied to the phosphor screen 10.

An optical image 11 is projected from a device (not shown) onto the photocathode 5 through the input window 3 on a line passing through the center of the photocathode 5. The photocathode 5 then emits an image of electrons corresponding to the optical image. The emitted electrons are accelerated by the mesh electrode 6, focused by the focusing electrode 7, pass through the aperture electrode 8, and enter the gap between the deflection electrodes 9.

While the linear electron image is passing through the gap between the deflection electrodes 9, a ramp deflection voltage is applied between the deflection electrodes 9 to produce a deflection electric field that deflects the electron image. The deflected electron image is applied to the phosphor screen 10.

At this time, the electric field generated by the deflection voltage is directed perpendicularly to both the tube axis and the linear electron image, i.e., perpendicularly to the sheet of drawing in the case of FIG. 1A, and parallel to the sheet of drawing in the case of FIG. 2A. The intensity of the electric field is proportional to the deflection voltage. The linear electron beam is scanned in a direction perpendicular to the longitudinal direction of the linear electron beam and an optical image, referred to as a streaked image, is formed on the phosphor screen 10. The streaked image is an array of images that are in the time domain of the linear optical image on the photocathode 5 and are arranged in the direction perpendicular to the linear optical image. Therefore, any change in the brightness of the streaked image along its image array, i.e., in the direction in which it is swept, is representative of a time-dependent change in the intensity of the optical image 11.

In the streak tube, the photoelectrons emitted from the photocathode have various energies. Therefore, the photoelectrons that have simultaneously been emitted from the photocathode 5 reach the deflection electrodes 9 at different times, resulting in a travel time spread of the photoelectrons. The travel time spread is partly responsible for a limited time resolution of the streak tube 1.

Generally, the energy distribution of the photoelectrons emitted from the photocathode is determined by the type of the photocathode and the wavelength of the light to be measured, and the acceleration of the photoelectrons is determined by a distribution of potentials along the tube axis from the photocathode to the deflection electrodes. Consequently, the travel time spread is determined by the type of the photocathode, the wavelength of the light to be measured, and the potential distribution along the axis of the streak tube.

Heretofore, in order to reduce the travel time spread, the acceleration mesh electrode is disposed in proximity with the photocathode to accelerate the photoelectrons quickly for thereby minimizing a region in which the photoelectrons travel at low speed in the vicinity of the photocathode. The travel time spread between the photocathode and the mesh electrode is determined by only the electric field therebetween once the type of the photocathode used and the wavelength of the light to be measured are given.

FIG. 3 shows the relationship between the electric field and the travel time spread when the wavelength of the light to be measured is 500 nm with the use of a photocathode S-20 according to the standards of Electronic Mechanical Industrial Association of the United States. Study of FIG. 3 indicates that theoretically, the travel time spread can be reduced to any desired level if the electric field is increased. Actually, however, when the surface of the photocathode is in a potential of 6 kV/mm or higher, the photocathode emits a dark current due to the field emission effect even if no incident light is applied to the photocathode, thereby increasing noise-induced background emission on the output phosphor screen and thus degrading a signal-to-noise ratio.

If the photocathode has a minute surface projection thereon, then there is developed a very strong electric field on the surface of the photocathode. The photocathode produces a very large dark current due to the tunnel effect, and the dark current induces a white spot on the output phosphor screen.

The background emission on the output phosphor screen may be reduced by applying a voltage between the photocathode and the mesh electrode for a very short period of time, thereby reducing the time in which any dark current is generated. To this end, a short pulse voltage as shown in FIG. 4, for example, may be applied to the photocathode through flange electrodes which support the input window on which the photocathode is mounted.

However, inasmuch as a portion of the applied pulse voltage wave is reflected because of the lack of impedance matching, or owing to a high electrostatic capacitance between the flange electrodes, a reduced voltage whose waveform is less sharp as shown in FIG. 5 is applied to the photocathode. As a consequence, it is not possible to apply a pulse voltage of required magnitude, and an acceleration voltage is applied between the photocathode and the acceleration electrode for a period of time longer than the duration of the pulse voltage that has been generated by a pulse voltage power supply. The initially intended application of a voltage for a short period of time for the reduction of the time in which a dark current is generated, cannot therefore be achieved.

Moreover, the distance between the photocathode and the acceleration electrode in the conventional streak tube cannot be reduced to 0.5 mm or less. The distance therebetween is set in such a manner that upon interposing a spacer of a predetermined thickness between the photocathode and the acceleration electrode, the latter is welded to supporting portions extending from the outer wall of the streak tube. With such a setting, a high assembling accuracy cannot be attained due to the deformation of the electrode resulting from the presence of the spacer and the welding.

If the travel time spread of the photoelectrons between the photocathode and the acceleration electrode is to be suppressed within 50 fs or shorter, then a pulse voltage of 36 kV/mm or 18 kV/0.5 mm is required to obtain a relevant electric field. However, it is extremely difficult to produce such a high voltage with a very short pulse duration of 1 ns, for example.

SUMMARY OF THE INVENTION

The present invention has been made to solve the above-described conventional problems. Accordingly, it is an object of the present invention to provide a streak tube which allows a pulse voltage having a very short pulse duration to be applied between a photocathode and an acceleration electrode while preventing the pulse voltage from becoming less sharp in waveform and also from dropping.

Another object of the present invention is to provide a streak tube which has a photocathode and an acceleration electrode that are spaced from each other by a distance which is much smaller than heretofore and are assembled with high accuracy, so that a required electric field can be produced between the photocathode and the acceleration electrode without having to applying a high pulse voltage.

Briefly, and in accordance with the present invention, a streak tube has a photocathode and an acceleration electrode disposed in confronting relation to the photocathode, for accelerating a photoelectron beam emitted from the photocathode, wherein at least one of the photocathode and the acceleration electrode is formed on a strip-like electrode. A pulse voltage is applied to the strip-like electrode so that a very intensive pulsed electric field is developed between the photocathode and the acceleration electrode. The photocathode and the acceleration electrode have respective interactive regions closely spaced from each other.

According to one aspect of the present invention, there is provided a streak tube which comprises a glass bulb extending in its longitudinal axis and having two open ends opposite to each other, an input window attached to one open end of the glass bulb, the input window having a first surface to which light is applied and a second surface directed inwardly of the glass bulb, an output window attached to another open end of the glass bulb, the output window having a surface directed inwardly of the glass bulb, the glass bulb, the input window, and the output window defining a hermetic vacuum casing, a phosphor screen formed on the surface of the output window, a photocathode disposed inside the vacuum casing for emitting a photoelectron beam in response to the light applied to the first surface of the input window, a first acceleration electrode disposed in confronting relation to the photocathode for accelerating the photoelectron beam emitted from the photocathode, wherein at least one of the photocathode and the first acceleration electrode is formed on a strip-like electrode, and wherein the photocathode and the first acceleration electrode have interactive regions positioned closely to each other, deflection means for deflecting the photoelectron beam to form a streaked image on the phosphor screen, pulse voltage generating means for generating a pulse voltage, and conductor means for connecting the pulse voltage generating means to either the photocathode or the first acceleration electrode to apply the pulse voltage thereto and develop an electric field between the photocathode and the first acceleration electrode.

According to another aspect of the present invention, there is provided a process for manufacturing a streak tube which comprises steps of placing the second surface of the input window spaced apart from the acceleration electrode by a distance ranging from 10 to 20 mm, forming the photocathode on the second surface of the input window, finely adjusting a position of the interactive region of the photocathode relative to the interactive region of the acceleration electrode to be spaced apart by a distance equal to or less than 0.5 mm, inserting a spacer between the one open end of the glass bulb and the input window, and bonding the input window and the one open end of the glass.

The streak tube according to the present invention can generate a streaked image with a very high time resolution without an increase in the background emission on an output phosphor screen.

The above and other objects, features and advantages of the present invention will become more apparent from the following description when taken in conjunction with the accompanying drawings in which preferred embodiments of the present invention is shown by way of illustrative examples.

DETAILED DESCRIPTION OF THE PREFERRED EMBODIMENTS

Various embodiments of the present invention will hereinafter be described with reference to the accompanying drawings.

Figure 1B:
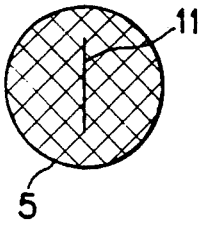
FIG. 1B PRIOR ART
FIG. 1B is a diagram showing the relationship between a photocathode and an input optical image in the conventional streak tube.
Figure 1A:
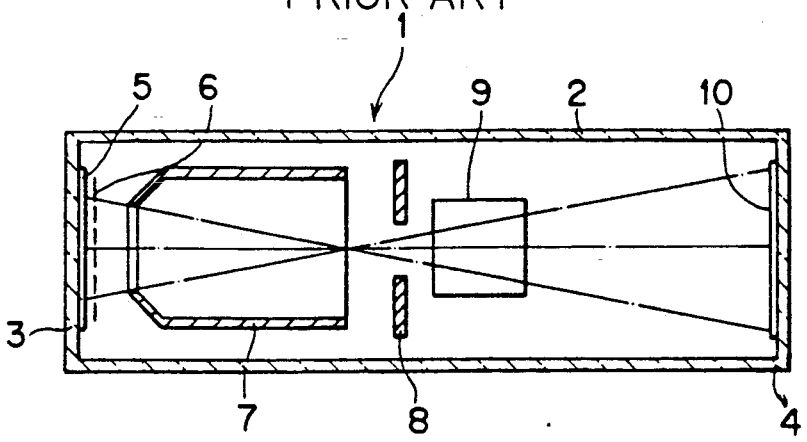
FIG. 1A PRIOR ART
FIG. 1A is a cross-sectional view showing a conventional streak tube.
Figure 2B:
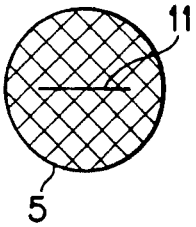
FIG. 2B PRIOR ART
FIG. 2B is a diagram showing the relationship between a photocathode and an input optical image in the conventional streak tube shown in FIG. 2A.
Figure 2A:
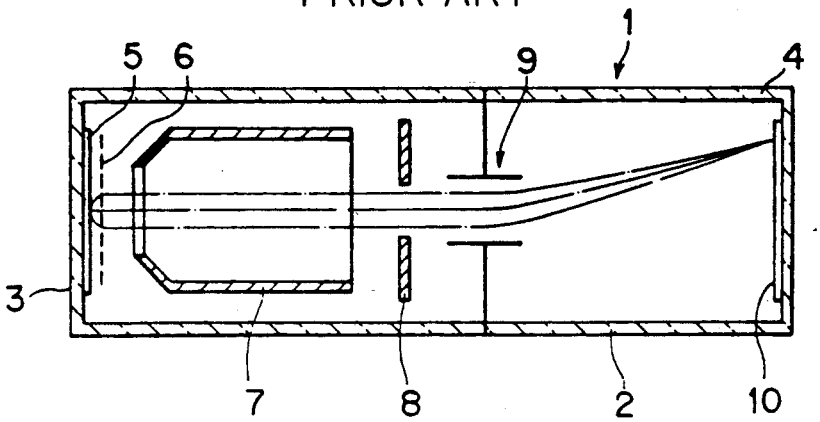
FIG. 2A PRIOR ART
FIG. 2A is a cross-sectional view showing the conventional streak tube, the view being taken along a plane normal to FIG. 1A.
Figure 3:
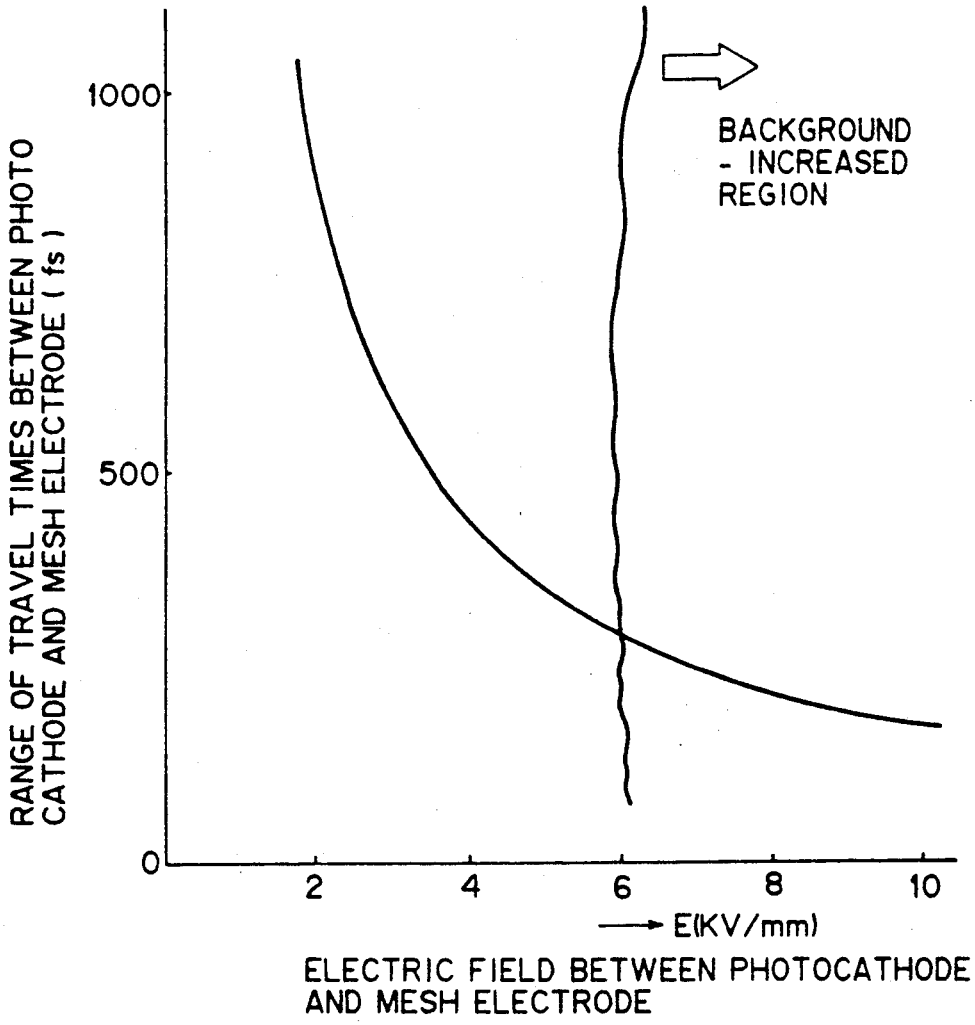
FIG. 3 is a diagram showing the relationship between an electric field developed between a photocathode and an acceleration electrode and a travel time spread of photoelectrons between the photocathode and the acceleration electrode.
Figure 4:
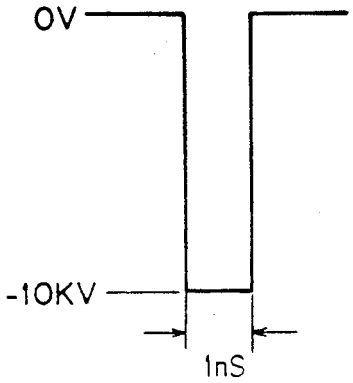
FIG. 4 is a diagram showing a pulse voltage applied to the photocathode or the acceleration electrode.
Figure 5:
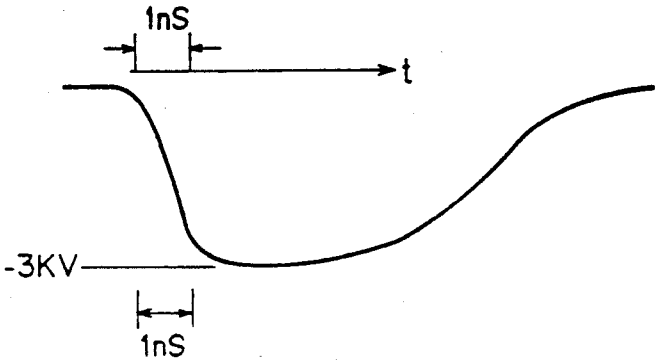
FIG. 5 is a diagram showing the waveform of a pulse voltage as it is actually applied to the photocathode or the acceleration electrode.
Figures 6A, 6B:
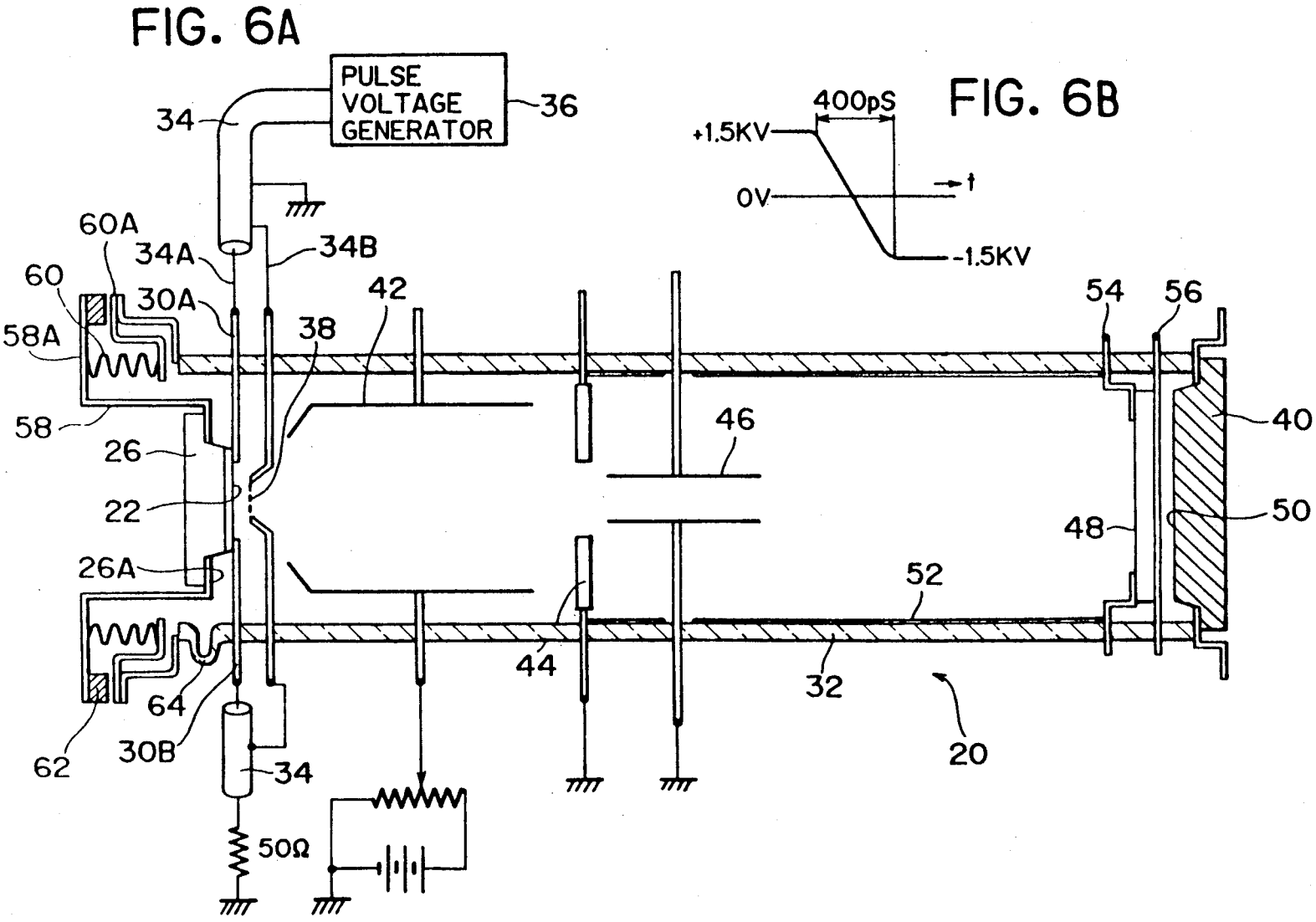
FIG. 6A–B is a cross-sectional view showing a streak tube according to a first embodiment of the present invention.
Figure 7A:
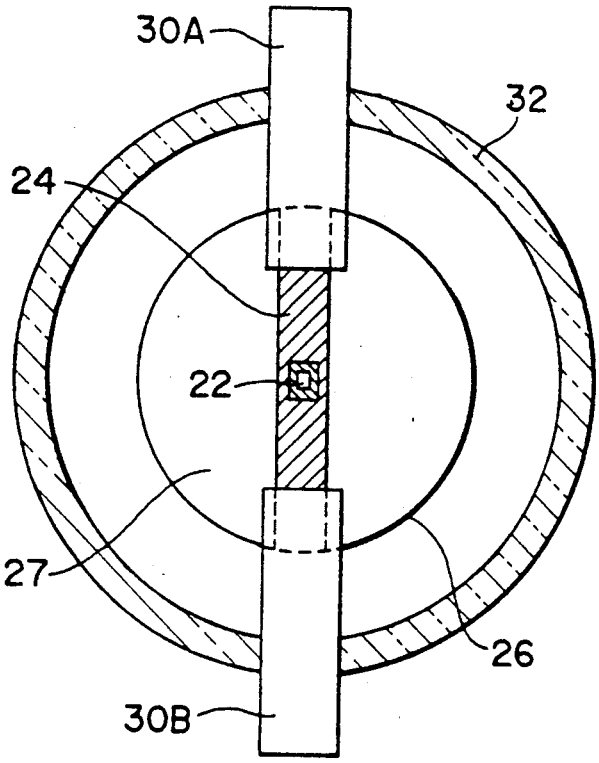
FIGS. 7A and 7B are cross-sectional views showing at an enlarged scale a strip transmission line and a photocathode according to the first embodiment of the present invention.
Figure 7B:
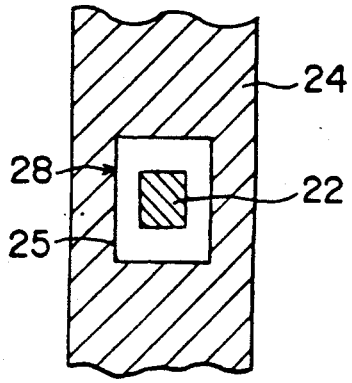

As shown in FIGS. 6, 7A and 7B, a photocathode 22 in a streak tube 20 is formed on a strip transmission line 24. The streak tube 20 has an input window 26 comprising a glass panel that is convex into one end of a glass bulb 32 of the streak tube 20. The photocathode 22 is disposed on an inner end surface 27 of the glass panel that projects into the glass bulb 32.

The strip transmission line 24 is in the form of an evaporated film of gold deposited on the inner end surface of the input window 26, the evaporated film of gold having a width of 5 mm. The strip transmission line 24 includes a gold-film-free area 25 at the center of the input window 26, the gold-film-free area 25 having a size of 0.5 mm×0.5 mm.

In the gold-film-free area 25, there is evaporated a semitransparent tungsten base layer 28 in the pattern of a square having a size greater than the size of 0.5 mm×0.5 mm, with peripheral edges overlapping the surrounding evaporated film of gold. The photocathode 22 is disposed on the tungsten base layer 28.

As shown in FIG. 7A, the strip transmission line 24 extends diametrically across the inner end surface 27 of the input window 26. Sealed leads 30A, 30B are connected respectively to the opposite ends of the strip transmission line 24. As shown in FIG. 6, the sealed leads 30A, 30B have ends projecting radially outwardly from a glass bulb 32 of the streak tube 20 and connected respectively to cores 34A of coaxial cables 34 which have an impedance of 50 Ω. One of the coaxial cables 34 is connected to the output terminal of a pulse voltage generator 36, while the other coaxial cable 34 is connected to a resistor of 50 Ω that is grounded. Each of the coaxial cables 34 has an outer shield 34B that is coupled to an acceleration electrode 38 in the glass bulb 32.

The streak tube 20 has an output window 40 on the end of the glass bulb 32 remote from the input window 26. Between the acceleration electrode 38 and the output window 40, there are disposed a focusing electrode 42, an anode 44, deflection electrodes 46, and a microchannel plate (MCP) 48 in the glass bulb 32. The output window 40 has a phosphor screen 50 in its inner surface.

In FIG. 6, a wall electrode 52 is disposed on the inner surface of the glass bulb 32 between the anode 44 and the microchannel plate 48. The microchannel plate 48 has an MCP input electrode 54 and an MCP output electrode 56.

The input window 26 is supported by a support cylinder 58 having a peripheral flange 58A that is supported on the end of the glass bulb 32 by bellows 60. The end of the glass bulb 32 and the flange 58A are spaced from each other by a spacer 62.

Next, description will be made with respect to the formation of the photocathode 22 and the positioning of the photocathode 22 with respect to the acceleration electrode 38 using the bellows 60 and the spacer 62.

While the bellows 60 is being extended, the inner end surface 27 of the input window 26 and the acceleration electrode 38 are spaced from each other by a distance ranging from 10 to 20 mm. Then, an evaporation source of antimony, from which the photocathode will be formed, is introduced into the glass bulb 32 through a photocathode fabrication tip 64. An antimony layer is evaporated on the tungsten base layer 28, and an alkaline metal vapor is also introduced into the glass bulb 32, thereby forming an S-20 photocathode 22 on the tungsten base layer 28.

After the photocathode 22 is formed, the bellows 60 is contracted and fine adjustments are made to keep the photocathode 22 and the acceleration electrode 38 spaced from each other by a distance equal to or less than 0.5 mm. If the distance is, for example, adjusted to 0.2 mm, then the spacer 62 is placed between the flange 58A and a flange 60A of the bellows 60 and bonded thereto by adhesive. The distance between the photocathode 22 and the acceleration electrode 38 is thus set to 0.2 mm.

The acceleration electrode 38 is of a frustoconical shape projecting toward the photocathode 22 and has a hollow inner space. A circular mesh having a mesh size of 1000 mesh/inch is bonded to the tip end of the frustoconical acceleration electrode 38.

Various voltages are applied to the electrodes as follows: For example, a voltage of +15 kV is applied to the focusing electrode 42, and a voltage of 0 V is applied to each of the acceleration electrode 38, the wall electrode 52, and the MCP electrode 54. A voltage of +800 V is applied to the MCP output electrode 56, and a voltage of +3.8 kV is applied to the phosphor screen 50. A ramp voltage that varies from +1.5 kV to −1.5 kV in 400 ps, as shown in FIG. 6, is applied between the deflection electrodes 46 in timed relation to a flow of photoelectrons therebetween. A pulse voltage is applied from the pulse voltage generator 36 to the photocathode 22 only during a period of streaking operation, and a voltage of 0 V is applied to the photocathode 22 when no streaking operation is effected (see FIG. 8).

A process of measuring light with the streak tube 20 will be described below.

When light to be measured is applied from the input window 26 through the semitransparent tungsten base layer 28 to the photocathode 22, an electric field is developed between the photocathode 22 and the acceleration electrode 38 so that a period of time in which the light to be measured is to be seized as a streaked image on the phosphor screen 50, is included in a period of time during which a pulse voltage is applied to the photocathode 22.

Figure 8:
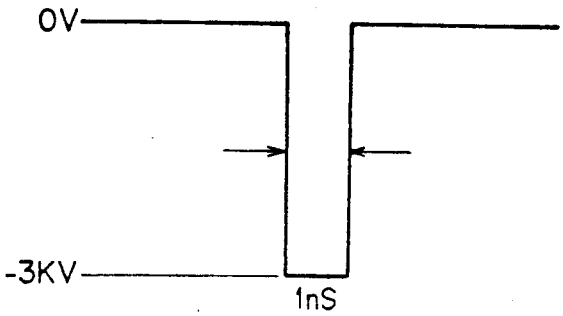
FIG. 8 is a diagram showing a pulse voltage applied to the strip transmission line in the first embodiment of the present invention.

More specifically, the pulse voltage generator 36 generates a pulse voltage as shown in FIG. 8, and the generated pulse voltage is applied to the photocathode 22 through the coaxial cable 34, the sealed lead 30A, and the strip transmission line 24. At this time, the pulse voltage is of −3 kV and has a duration of 1 ns. The pulse voltage is drained to ground through the other sealed lead 30B and the resistor of 50Ω.

Since the pulse voltage is applied through the strip transmission line 24 that is impedance-matched, the pulse voltage does not suffer any voltage loss which would otherwise be caused by waveform deformations and reflections. The photocathode 22 and the acceleration electrode 38 thus develop therebetween a high-speed pulsed electric field corresponding to the voltage generated by the pulse voltage generator 36.

As described above, the distance between the photocathode 22 and the acceleration electrode 38 is set to 0.2 mm. Therefore, the intensity of the electric field produced by the pulse voltage of −3 kV has a very large value of 15 kV/mm, thereby strongly accelerating photoelectrons emitted from the photocathode 22. Accordingly, any travel time spread of the photoelectrons due to an initial speed distribution in the emission from the photocathode 22 is minimized. Since the pulse voltage is applied to the photocathode 22 in a very short time of 1 ns, any dark current produced under the high electric field developed by the pulse voltage is negligibly small.

The photoelectrons emitted from the photocathode 22 and accelerated by the acceleration electrode 38 are focused onto the input surface of the microchannel plate 48 by the focusing electrode 42 to which the voltage of 15 kV is applied. Inasmuch as the high positive voltage is applied to the focusing electrode 42, thus forming an electric focusing lens, the travel time spread of the photoelectrons is small in the focusing electrode 42.

After having traveled past the focusing electrode 42, the photoelectron beam is swept by the deflection electrodes 46, multiplied by the microchannel plate 48, and applied to the output phosphor screen 50 on which a streaked image is formed. In this embodiment, the streak tube 20 has 100 fs order time resolution. Since the distance between the photocathode 22 and the acceleration electrode 38 can be set to a value smaller than manufacturing errors using the bellows 60, a high electric field can be developed and emitted photoelectrons can be quickly accelerated without the application of a higher voltage.

As the photocathode 22 is formed on the impedance-matched strip transmission line 24, part of the pulse voltage wave applied through the strip transmission line 24 to the photocathode 22 is not reflected, and a desired ultrashort and very intensive pulsed electric field can be developed between the photocathode 22 and the acceleration electrode 38.

In the above embodiment, the distance between the photocathode 22 and the acceleration electrode 38 is set to a value smaller than manufacturing errors through fine adjustments using the bellows 60 after the photocathode 22 is formed. However, the present invention is not limited to the above arrangement, but the distance between the photocathode 22 and the acceleration electrode 38 may be minimized by other means or with increased fabrication accuracy. For example, indium may be employed as in a second embodiment shown in FIG. 9.

Figure 9:
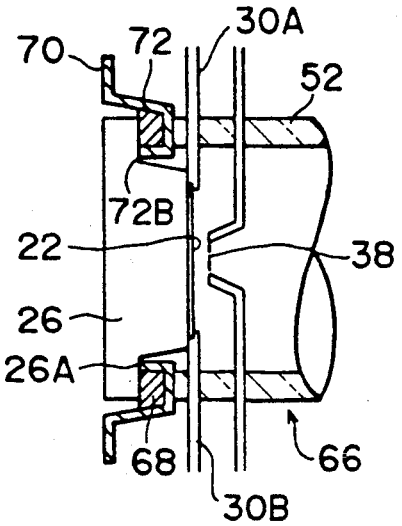
FIG. 9 is a fragmentary cross-sectional view showing another means for positioning a photocathode with respect to an acceleration electrode according to a second embodiment of the present invention.

According to the second embodiment shown in FIG. 9, the input window 26 of a streak tube 66 is affixed in position by a member 68 of indium. More specifically, a flange 70 is attached to an end face of a glass bulb 32 of a streak tube 66, and the indium member 68 is disposed in a radially inner recess 72 defined in the flange 70 at a lefthand end surface thereof as shown. The larger-diameter inner surface 26A of the input window 26 is brought into intimate contact with the inner top face 72B of the flange 70, wherein a distance between the photocathode 22 and the acceleration electrode 38 is set to be, for example, 0.15 mm. Since the indium member 68 is soft in property, it can easily be deformed to allow the distance between the photocathode 22 and the acceleration electrode 38 to be set as described above. Accordingly, the distance between the photocathode 22 and the acceleration electrode 38 can be minutely reduced as desired with high accuracy. The inner flange portion serving as a stopper at the time of compression of the indium member may not be provided. In such a case, a tool or machine may stop performing the indium sealing when it is detected that the distance between the photocathode 22 and the acceleration electrode 38 is equal to a desired value.

Figure 10A:
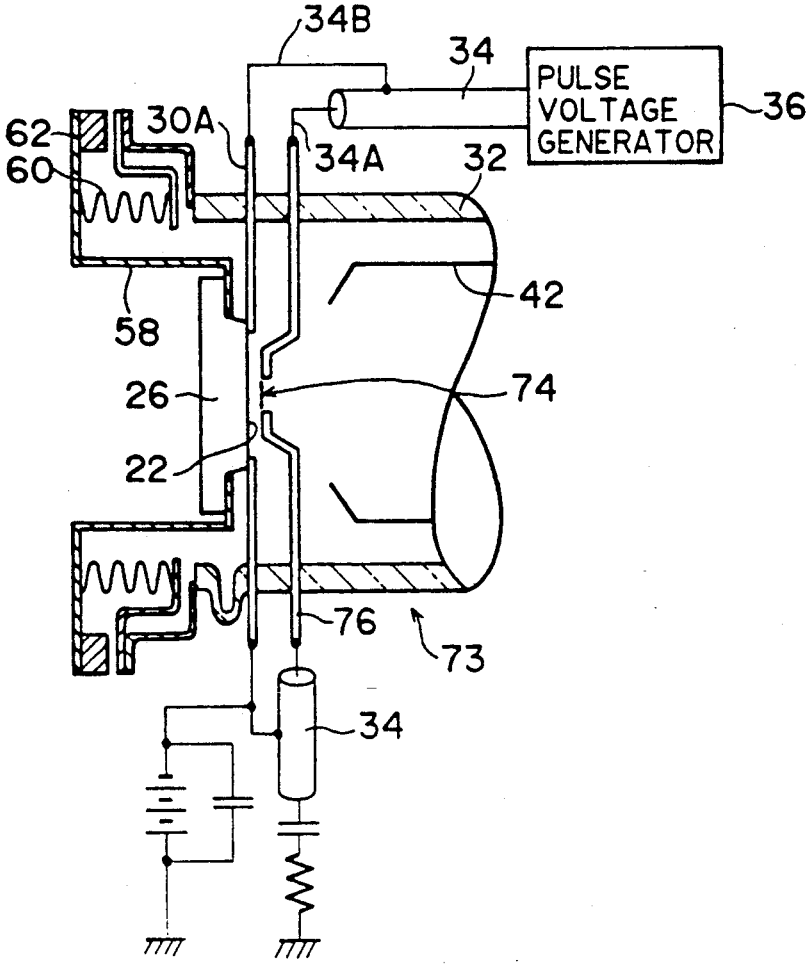
FIG. 10A is a cross-sectional view showing a streak tube according to a third embodiment of the present invention.
Figure 10B:
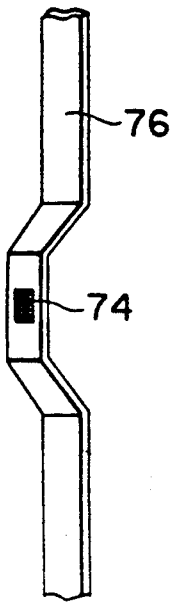
FIG. 10B is an enlarged perspective view showing an acceleration electrode in the third embodiment of the present invention.

A third embodiment of the present invention will be described below with reference to FIGS. 10A and 10B.

A streak tube 73 according to the third embodiment has an acceleration electrode 74 mounted on a strip transmission line 76, and the shields 34B of the coaxial cables 34 are connected to the photocathode 22. As shown at an enlarged scale in FIG. 10B, the acceleration electrode 74 is in the form of a mesh disposed in a hole, which has a size of 0.5×0.5 mm, for example, defined in a central region of the strip transmission line 76 which is of a trapezoidal cross section projecting toward the photocathode 22, the acceleration electrode 74 confronting the photocathode 22.

Figure 11:
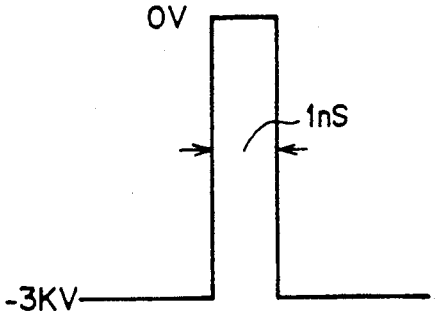
FIG. 11 is a diagram showing a pulse voltage applied to the acceleration electrode in the third embodiment of the present invention.

A DC voltage of −3 kV is applied to the photocathode 22. The pulse voltage generator 36 is biased by −3 kV to generate a positive pulse voltage of 3 kV whose duration is 1 ns, as shown in FIG. 11.

Operation of the third embodiment is the same as that of the first embodiment, and thus the description thereof is omitted herein.

A fourth embodiment of the present invention will be described below with reference to FIG. 12.

A streak tube 77 according to the fourth embodiment is of substantially the same structure as that of the first embodiment shown in FIG. 6, except for an additional second acceleration electrode 78. The second acceleration electrode 78 comprises a mesh that is spaced from the acceleration electrode 38 by 5 mm, for example, and a positive DC voltage of 20 kV is applied to the second acceleration electrode 78. The other structural details of the fourth embodiment are the same as those of the first embodiment, and those parts of the fourth embodiment which are identical to those of the first embodiment are denoted by identical reference numerals and thus the description thereof is omitted.

In the fourth embodiment, the photoelectrons accelerated under the pulsed electric field developed between the photocathode 22 and the acceleration electrode 38 are further accelerated under the DC voltage of +20 kV applied to the second acceleration electrode 78, to a speed corresponding to the high DC voltage of +20 kV. Consequently, the travel time spread of the photoelectrons past the acceleration electrodes is reduced.

While the voltage of +20 kV applied to the second acceleration electrode 78 is high, it can easily be generated as it is a DC voltage. The second acceleration electrode 78 is spaced from the acceleration electrode 38 by a relatively large distance. The electric field developed between the second acceleration electrode 78 and the acceleration electrode 38 is of a relatively low value of 4 kV/mm. Therefore, the background emission is not increased under the electric field developed between the second acceleration electrode 78 and the acceleration electrode 38.

In the above embodiments, each of the acceleration electrodes is in the form of a mesh. However, as shown in FIG. 13A, an acceleration electrode may have a slit 80 parallel to the deflection electrodes 46, the slit 80 having a length of 1 mm and a width of about 30 μm, for example. Alternatively, an acceleration electrode may have an aperture having a diameter of 0.5 mm. If the acceleration electrode with a slit or an aperture is employed, the dark current that has been produced is blocked by the other region of the acceleration electrode than the slit or the aperture through which the photoelectrons pass, so that the background emission is prevented from increasing. The acceleration electrode 78 shown in FIG. 12 may also have a slit or aperture. If the acceleration electrode has only a slit or an aperture, then the electric potential tends to be disturbed. To avoid this, the acceleration electrode may have a fine mesh disposed in superposed relationship to the slit or the aperture.

Figures 14A, 14B, 14C, 14D:
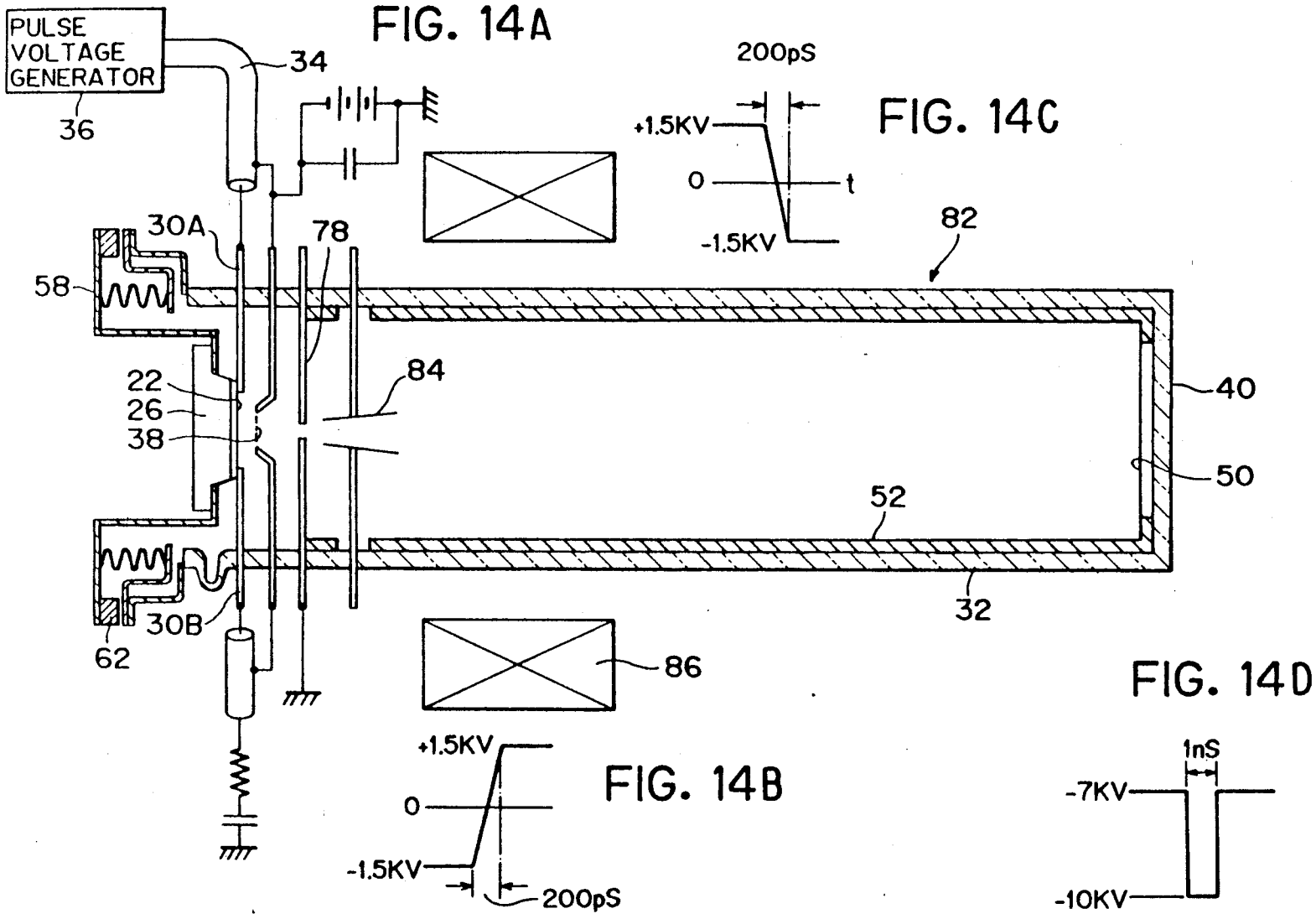
FIG. 14A–D is a fragmentary cross-sectional view showing a streak tube according to a fifth embodiment of the present invention, the view also showing a circuit.

A fifth embodiment of the present invention will be described below with reference to FIG. 14.

In the fifth embodiment, deflection electrodes 84 are disposed near the second acceleration electrode 78 in a streak tube 82. A focusing coil 86 is positioned behind the deflection electrodes 84. The distance between the photocathode 22 and the acceleration electrode 38 is 0.08 mm, the distance between the acceleration electrode 38 and the second acceleration electrode 78 is 4 mm, and the distance between the second acceleration electrode 78 and the deflection electrodes 84 is 3 mm. The acceleration electrode 38 comprises a mesh, and the second electrode 78 has an aperture defined therein.

The other structural details of the fifth embodiment are the same as those of the first embodiment, and those parts of the fifth embodiment which are identical to those of the first embodiment are denoted by identical reference numerals and thus the description thereof is omitted.

Figure 12:
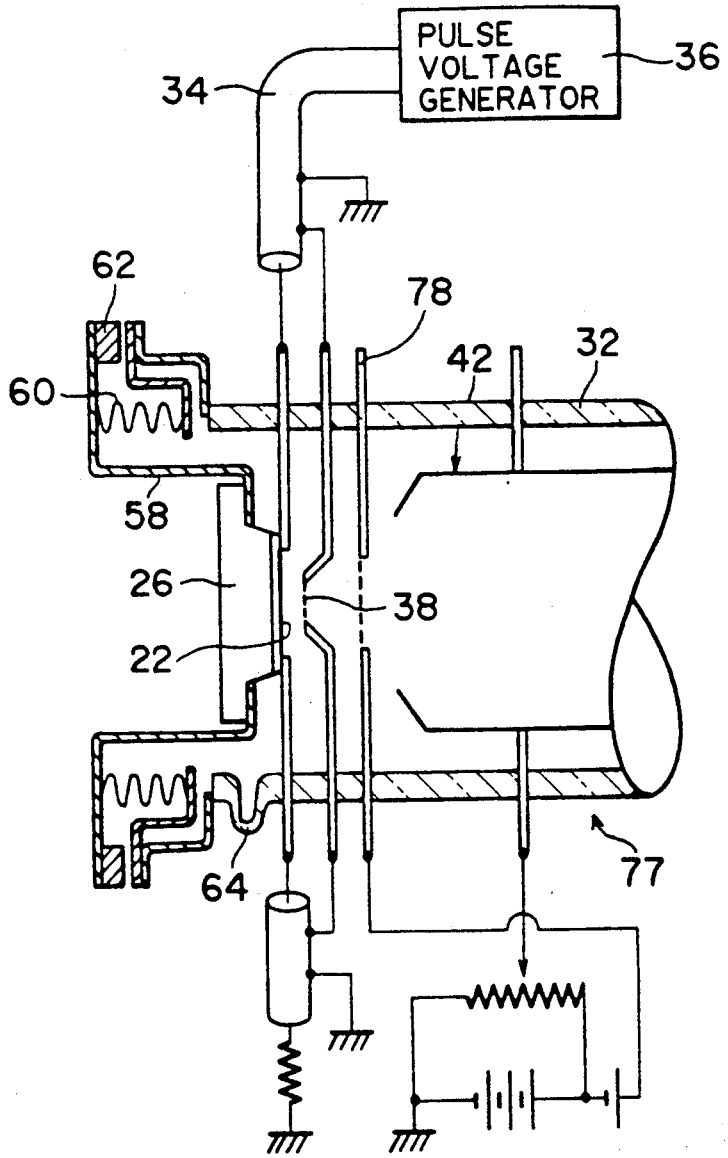
FIG. 12 is a fragmentary cross-sectional view showing a streak tube according to a fourth embodiment of the present invention, the view also showing a circuit.
Figure 13A:
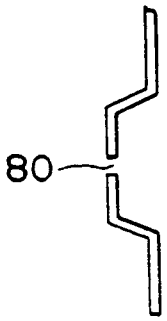
FIGS. 13A and 13B are cross-sectional and front elevational views showing another acceleration electrode.
Figure 13B:
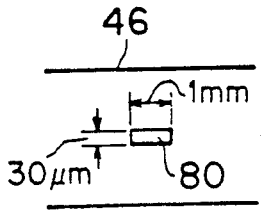

In the streak tubes shown in FIGS. 6 and 12, since the deflection electrodes are spaced from the photocathode by several tens mm or more, the travel time spread of the photoelectrons due to an initial speed distribution or a space charge effect is not negligible. In the fifth embodiment, however, a very intensive pulsed electric field is developed between the photocathode and the acceleration electrode to reduce the travel time spread during an initial period, and the deflection electrodes 84 are disposed immediately behind the second acceleration electrode 78 for more effectively reducing the travel time spread.

When a pulse voltage is applied to the photocathode 22 by the pulse voltage generator 36, a very intensive pulsed electric field of 37.5 kV/mm is developed between the photocathode 22 and the acceleration electrode 38 for 1 ns. The photoelectrons that have been accelerated by the pulsed electric field are further accelerated by the second acceleration electrode 37, and then immediately deflected by the deflection electrodes 84. A ramp voltage that varies from +1.5 kV top −1.5 kV for 200 ps is applied to one of the deflection electrodes 84, and a ramp voltage that varies from −1.5 kV to +1.5 kV for 200 ps is applied to the other deflection electrode 84. After having been deflected by the deflection electrodes 84, the photoelectrons are focused as a streaked image on the phosphor screen 50 by the focusing coil 86.

In this embodiment, a time resolution of 50 fs is achieved when the photoelectrons are deflected by the deflection electrodes 84 immediately after they have been accelerated by the acceleration electrode 38 and the second acceleration electrode 78.

Although the present invention has been described with respect to specific embodiments, it will be appreciated by one skilled in the art that a variety of changes and modifications may be made without departing from the scope of the invention. Certain features may be used independently of others and equivalents may be substituted all within the scope and spirit of the invention. For example, in the above embodiments, the distance between the photocathode and the acceleration electrode is adjusted to a desired small value using the bellows or the indium member. However, the present invention is not limited to such an arrangement. For example, the distance between the photocathode and the acceleration electrode may further be reduced by increased fabrication accuracy.

The photocathode or the acceleration electrode is formed on the strip transmission line in the above embodiments. However, the photocathode or the acceleration electrode may be formed on a strip-like electrode which is impedance-matched and can generate a very short and very intensive pulsed electric field between the photocathode and the acceleration electrode with a relatively low pulse voltage.

The strip transmission line or the strip-like electrode may vary in width in order to uniformize the impedance with respect to the acceleration electrode or the photocathode which confronts the strip transmission line or the strip-like electrode.

While one of the photocathode and the acceleration electrode is formed on the strip transmission line or the strip-like electrode, both of the photocathode and the acceleration electrode may be formed on the strip transmission line or the strip-like electrode.

What is claimed is:

1. A streak tube comprising:

a glass bulb extending along a longitudinal axis and having two open ends opposite to each other;

an input window attached to one open end of said glass bulb, said input window having a first surface to which light is applied and directed outwardly of said glass bulb and a second surface directed inwardly of said glass bulb;

an output window attached to another open end of said glass bulb, said output window having a surface directed inwardly of said glass bulb, said glass bulb, said input window, and said output window defining a hermetic vacuum casing;

a phosphor screen formed on the surface of said output window;

a photocathode disposed inside the vacuum casing for emitting a photoelectron beam in response to the light applied to the first surface of said input window;

a first acceleration electrode disposed in confronting relation to said photocathode for accelerating the photoelectron beam emitted from said photocathode, wherein at least one of said photocathode and said first acceleration electrode is formed on a strip-like electrode, and wherein said photocathode and said first acceleration electrode have interactive regions positioned closely to each other;

deflection means for deflecting the photoelectron beam to form a streaked image on said phosphor screen;

pulse voltage generating means for generating a pulse voltage; and conductor means for connecting said pulse voltage generating means to said strip-like electrode to apply the pulse voltage to the one of said photocathode and first acceleration elect rode that is formed on the strip-like electrode, in order to develop an electric field between said photocathode and said first acceleration electrode, wherein said strip-like electrode is impedance-matched with the conductor means.

2. The streak tube according to claim 1, wherein said photocathode is formed on said strip-like electrode, and said strip-like electrode is connected through said conductor means to said pulse voltage generating means, and wherein a desired ultrashort and very intensive pulsed electric field is developed between said photocathode and said first acceleration electrode, by impedance-matching the strip-like electrode and the conductor means.

3. The streak tube according to claim 1, wherein said first acceleration electrode is formed on said strip-like electrode, and said strip-like electrode is connected through said conductor means to said pulse voltage generating means, and wherein a desired ultrashort and very intensive pulsed electric field is developed between said photocathode and said first acceleration electrode by impedance-matching the strip-like electrode and the conductor means.

4. The streak tube according to claim 1, wherein said strip-like electrode comprises a metal film and a metal-film-free area, and wherein said strip-like electrode is deposited on the second surface of said input window and said photocathode is formed on said metal-film-free area.

5. The streak tube according to claim 4, wherein said strip-like electrode further comprises a semitransparent metal base layer formed in overlapping relation to said metal-film-free area, said photocathode being disposed on said metal base layer.

6. The streak tube according to claim 1, wherein said conductor means comprises first and second coaxial cables, each having a core and an outer shield, and first and second sealed leads, the first sealed lead having a first end portion connected to one end portion of said strip-like electrode and a second end portion connected to the core of the first coaxial cable which in turn is connected to said pulse voltage generating means, the outer shield of said first coaxial cable being grounded, and the second sealed lead having a first end portion connected to another end portion of said strip-like electrode and a second end portion connected to the core of the second coaxial cable which in turn is grounded.

7. The streak tube according to claim 6, wherein said first acceleration electrode is connected to outer shield of said first coaxial cable.

8. The streak tube according to claim 1, wherein when said first acceleration electrode is formed on said strip-like electrode, said strip-like electrode has the interactive region allowing the photoelectron beam to pass therethrough.

9. The streak tube according to claim 8, wherein the interactive region of said strip-like electrode in which said first acceleration electrode is formed is in a mesh form, said interactive region having a size of 0.5 mm×0.5 mm, said strip-like electrode having a trapezoidal cross section projecting toward the photocathode.

10. The streak tube according to claim 8, wherein the interactive region of said strip-like electrode in which said first acceleration electrode is formed is in a slit form, said slit having a length of approximately 1 mm and a width of approximately 30 μm, said strip-like electrode having a trapezoidal cross section projecting toward the photocathode.

11. The streak tube according to claim 8, wherein the interactive region of said strip-like electrode in which said first acceleration electrode is formed is in an aperture form, said aperture having a diameter of approximately 0.5 mm, said strip-like electrode having a trapezoidal cross section projecting toward the photocathode.

12. The streak tube according to claim 1, further comprising positioning means for positioning said photocathode relative to said first acceleration electrode.

13. The streak tube according to claim 12, wherein said positioning means comprises a supporting member for supporting said input window, and a bellow member interposed between the one open end of said glass bulb and said supporting member, said bellow member being deformed in the longitudinal axis of said glass bulb.

14. The streak tube according to claim 13, wherein a distance between the interactive regions of said photocathode and said first acceleration electrode is set to be less than 0.5 mm by said positioning means.

15. The streak tube according to claim 13, wherein said input window is convex into the one open end of said glass bulb, said photocathode being formed on a convex surface of sid input window, and wherein said first acceleration electrode has the interactive region projecting toward the interactive region of said photocathode.

16. The streak tube according to claim 12, wherein said positioning means comprises an indium seal member interposed between the one open end of said glass bulb and the second surface of said input window.

17. The streak tube according to claim 16, wherein a distance between the interactive regions of said photocathode and said first acceleration electrode is set to be less than 0.5 mm by said positioning means.

18. The streak tube according to claim 16, wherein said input window is convex into the one open end of said glass bulb, said photocathode being formed on a convex surface of sid input window, and wherein said first acceleration electrode has the interactive region projecting toward the interactive region of said photocathode.

19. The streak tube according to claim 1, further comprising a second acceleration electrode disposed between said first acceleration electrode and said deflection means, said second acceleration electrode being applied with a d.c. voltage for further accelerating the photoelectron beam having passed through said first acceleration electrode.

20. The streak tube according to claim 19, wherein said deflection means is disposed in proximity with said second acceleration electrode.

21. The streak tube according to claim 1, wherein said acceleration electrode has a trapezoidal cross section projecting toward the photocathode.

22. The streak tube according to claim 1, wherein said acceleration electrode has a trapezoidal cross section having two parallel sides, an imaginary line perpendicular to the two parallel sides being aligned parallel to the longitudinal axis of the glass bulb.

23. The streak tube according to claim 12, wherein said positioning means further includes:

a support cylinder, having a peripheral flange, for supporting the input window, a bellows that supports said peripheral flange, wherein an end of the glass bulb is spaced from the peripheral flange by a spacer.

24. The streak tube according to claim 12, wherein said positioning means further includes:

a flange attached to an end face of the glass bulb, an indium member disposed in a radially inner recess of the flange and at an outer end surface of the flange away from the glass bulb, wherein an inner surface of the input window contacts an inner top face of the flange.

25. The streak tube according to claim 24 wherein the indium member enables the distance between the acceleration electrode and the photocathode to be approximately 0.15 mm.

26. The streak tube according to claim 1, wherein a distance between the acceleration electrode and the photocathode is approximately 0.15 mm.

27. A process for manufacturing a streak tube including a glass bulb extending in its longitudinal axis and having two open ends opposite to each other, an input window attached to one open end of said glass bulb, said input window having a first surface to which light is applied and a second surface directed inwardly of said glass bulb, an output window attached to the other open end of said glass bulb, said output window having a surface directed inwardly of said glass bulb, said glass bulb, said input window, and said output window defining a hermetic vacuum casing, a phosphor screen formed on the surface of said output window, a photocathode disposed inside the vacuum casing for emitting a photoelectron beam in response to the light applied to the first surface of said input window, an acceleration electrode disposed in confronting relation to said photocathode for accelerating the photoelectron beam emitted from said photocathode, wherein at least one of said photocathode and said first acceleration electrode is formed on a strip-like electrode, and wherein said photocathode and said acceleration electrode have interactive regions positioned closely to each other, deflection means for deflecting the photoelectron beam to form a streaked image on said phosphor screen, pulse voltage generating means for generating a pulse voltage, and conductor means for connecting said pulse voltage generating means to the strip-like electrode to apply the pulse voltage thereto and develop an electric field between said photocathode and said first accelerations electrode said strip-like electrode being impedance-matched with the conductor means, the process comprising the steps of:

placing the second surface of said input window spaced apart from said acceleration electrode by a distance ranging from 10 to 20 mm;

forming said photocathode on the second surface of said input window;

finely adjusting a position of the interactive region of said photocathode relative to the interactive region of said acceleration electrode to be spaced apart by a distance less than 0.5 mm; and bonding said input window and the one open end of said glass.

28. The process according to claim 27, further comprising the step of inserting a spacer between the one open end of said glass bulb and said input window after the fine adjustment.

29. The streak tube according to claim 27, wherein said process further comprises the steps of:

supporting the input window with a supporting cylinder, said supporting cylinder having a peripheral flange, supporting said peripheral flange with a bellows, and positioning a spacer between an end of the glass bulb and the peripheral flange to maintain a space therebetween.

30. The streak tube according to claim 27, wherein said process further comprises the steps of:

extending the bellows outwardly along the longitudinal axis of the glass bulb, in order to space the input window a distance greater than 10 mm from the acceleration electrode, introducing an evaporation source of antimony, from which the photocathode is formed, into the glass bulb through a photocathode fabrication tip, and contracting the bellow, after the photocathode is formed, to finely adjust the position of the photocathode and acceleration electrode.

* * * * *